United States Patent [19]

Haesebrouck et al.

[11] Patent Number: 4,973,005

[45] Date of Patent: Nov. 27, 1990

[54] HAMMER-CRUSHER ROTOR

[75] Inventors: Francis Haesebrouck, Versailles; René Bertho, Vitry, both of France

[73] Assignees: Usines et Acieries de Sambre et Meuse, Feignies; Compagnie Francaise des Ferrailles C.F.F., Paris, both of France

[21] Appl. No.: 434,817

[22] Filed: Nov. 13, 1989

[30] Foreign Application Priority Data

Nov. 10, 1988 [FR] France ..... 88 14703

[51] Int. Cl.[5] ..... B02C 13/26

[52] U.S. Cl. ..... 241/194

[58] Field of Search ..... 241/191, 194, 195, 197, 241/189 R, 300

[56] References Cited

U.S. PATENT DOCUMENTS 3,727,848 4/1973 Francis .
4,613,088 9/1986 Hausler et al. ..... 241/194 X

FOREIGN PATENT DOCUMENTS 3524725 1/1987 Fed. Rep. of Germany .
2304404 3/1975 France .
2522536 9/1983 France .
2143748 2/1985 United Kingdom ..... 241/194

*Primary Examiner*—Mark Rosenbaum
*Attorney, Agent, or Firm*—Young & Thompson

[57] ABSTRACT

A drive shaft (2) rigidly carries disks (4) through which parallel and eccentric hammer carrier axles (6) pass. Between the disks (4), hammers (7) are mounted pivotably about the hammer carrier axles (6). Protective covers (8) cover the disks (4) and the inter-disk spaces not occupied by hammers. Each cover (8) has the form of a sector of cylinder terminating in rims (11, 12) facing the drive shaft (2) and engaged in notches (13) of the disk. On a disk (4) two consecutive notches (13) between them define a dovetailed boss and form a retaining and guiding shaped portion avoiding the use of screw fastenings and serving as a slideway during assembly.

10 Claims, 2 Drawing Sheets

HAMMER-CRUSHER ROTOR

The present invention relates to a hammer-crusher rotor, especially a rotor for crushers serving for shredding metallic or composite articles, such as the bodies of motor vehicles or of domestic appliances.

The crushers at which the invention is directed comprise a stationary housing containing a rotor, the central drive shaft of which carries several flanges. Hammers are mounted pivotably between the flanges on eccentric axles passing through these flanges in parallel with the central shaft.

The inner walls of the stationary housing have an anvil-forming piece which, together with the hammers of the rotor, contributes to shredding the metallic articles delivered by a feed ramp. The shaft of the rotor is coupled to a motor which drives it at such a speed that the hammers carry out the shredding work under the cumulative effect of their kinetic energy and the centrifugal force which with great power returns them towards the position in which their center of gravity is at a maximum radial distance from the rotor-axis.

To prevent the periphery of the disks from being subjected to high wear by abrasion and shocks, it is known to surround the disks with removable protective plates made of a steel of a grade resistant to wear and to shocks.

According to FR-A-2, 522, 536, these plates are removable caps covering only the periphery of the flanges, to which they are fastened by means of screws. These caps are complicated to produce, and their assembly is lengthy and difficult because needing a large number of screws which, furthermore, during operation are exposed to contact with the articles being shredded. Moreover, these caps do not close off the spaces between the flanges.

According to FR-A-2, 304, 404 and DE-A-3, 524, 725, the protective plates togeher constitute a sleeve coversing the side wall of the rotor completely with the exception of passages provided for the hammers. According to DE-A-3, 524, 725 the elementary protective members are two half-shells having the indentations necessary for the passage of the hammers. According to FR-A-2, 304, 404, the elementary protective members are tiles arranged in axial rows, each associated with one of the hammer carrier axles. Each tile has an axial dimension corresponding to the interval of succession of the flanges. According to the two documents, the protective members possess, on their inner face retaining lugs which are engaged between the flanges and through each of which passes one of the hammer carrier axles.

The protective members known from FR-A-2, 304, 404 or DE-A-3, 524, 725 have disadvantages. They are parts produced, for example, by molding and are therefore costly to manufacture, particularly where the half-shells (DE-A-3, 524, 725) are concerned. As regards FR-A-2, 304, 404, the weight of the lug necessary for each protective tile makes the rotor considerably heavier and thereofore increases its cost price. In the two known devices, the centrifugal force experienced by the protective members is transmitted to the structure of the rotor by the hammer carrier axles, thereby increasing the load exerted on these and being conductive to the wear of the bores of the flanges.

According to U.S. Pat. No. 3, 727, 848, the protective members are caps covering the end of hammer carrier arms. These caps are themselves equipped with a lug, through which the hammer carrier axle passes. These lugs have shaped portions which interact with complementary shaped portions of the arms, in order to ensure retention in respect of the centrifugal force. Nevertheless, the protection is even more localized than according to FR-A-2, 522, 536, and the parts (caps and arms) are highly complex.

The object of the invention is to overcome the abovementioned disadvantages and, more particularly, to make more efficient the protective elements and the structure by means of which they are associated with the other elements of the rotor.

According to the invention, the hammer-crusher rotor intended particularly for the shredding of motor vehicles or of domestic appliances, having flanges fastened at an axial distance from one another along a drive shaft, with which they are integral in terms of rotation, these flanges supporting eccentric axles parallel to the drive shaft, whilst a hammer is mounted so as to oscillate on one of the eccentric axles in each space between two successive flanges, and protective covers covering the periphery of the flanges close off the periphery of the rotor partially, defining between them passages for the hammers, is defined in that each cover possesses, on the side facing the drive shaft, shaped portions for interengagement with complementary shaped portions formed on the periphery of the flanges, this interengagement allowing the axial sliding of the cover, at least during assembly, but retaining the cover radially.

Thus, the protective covers are retained directly by the flanges in respect of the centrifugal force. This load is therefore no longer transmitted by the hammer carrier axles and is no longer supported by the bores provided in the flanges for the hammer carrier axles. Furthermore, the amount of material necessary for ensuring the radial catching between the protective covers and the flanges can be limited to the minimum strictly necessary from a mechanical point of view, and the mass saved can be transferred to the hammers to make them even more efficient. On the other hand, in this regard, the lugs of the prior art are far from ideal because only their end parts located beyond the associated hammer carrier axle is effective, the rest of the lug performing the function of transmitting the retaining force between the said end part and the protective tile or half-shell. The assembling of the protective covers by axial sliding according to the invention is highly convenient. Furthermore, the covers can be composed of section portions cut to length. They are thus very economical to produce, and assembly is made easier because the number of covers can then be reduced considerably; each group of successive inter-flange gaps, in which a hammer carrier axle does not carry any hammer, can be covered with a single cover of appropriate length.

Other particular features and advantages of the invention will also emerge from the following description.

In the accompanying drawings given by way of non-limiting example:

Figure 1:
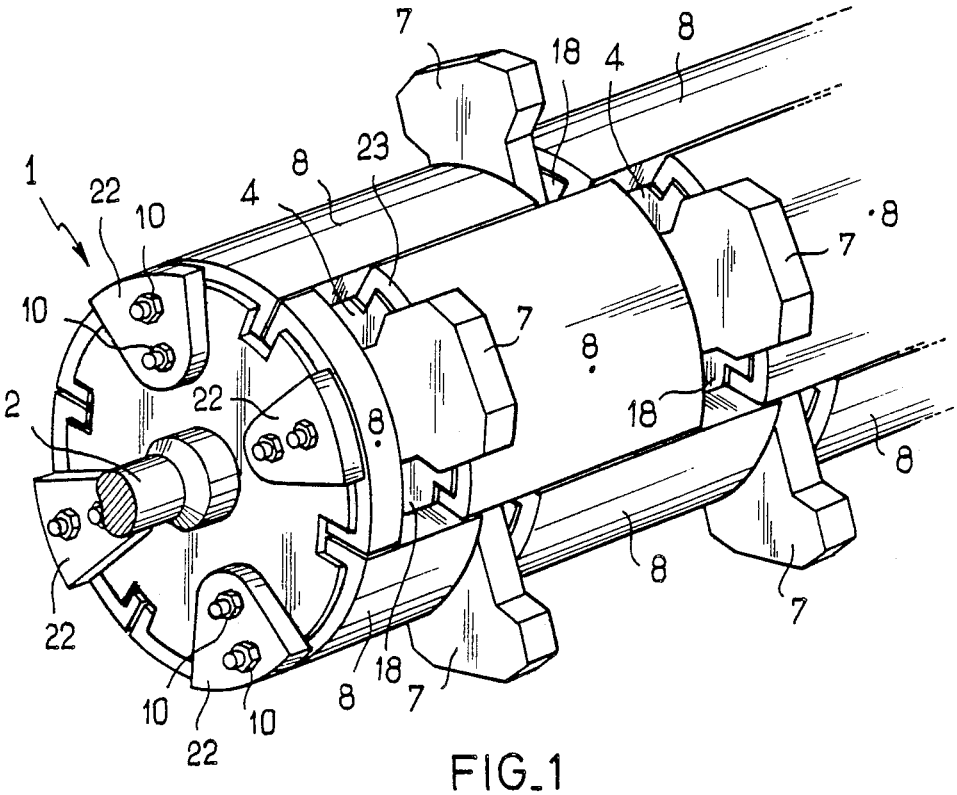
FIG. 1 is a partial perspective view showing diagrammatically a hammer-crusher rotor according to the invention.
Figure 2:
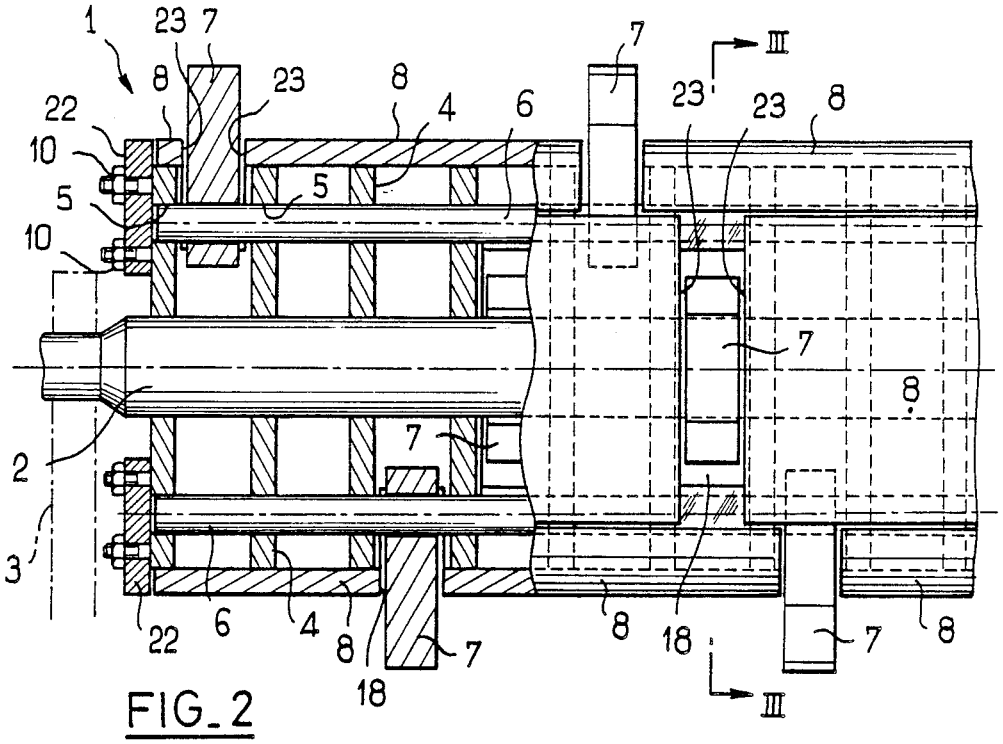
FIG. 2 is a partial longitudinal elevation view of the rotor of FIG. 1 partially in section along the plane II—II of FIG. 3.
Figure 3:
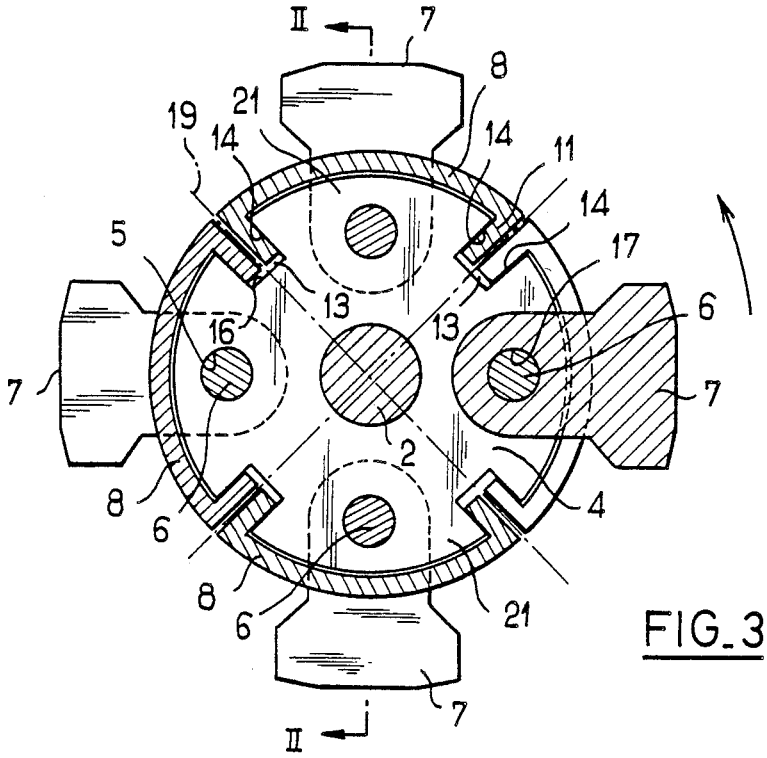
FIg. 3 is a cross-sectional view along the plane III—III of FIG. 2.

As shown in FIGS. 1 to 3, the rotor 1 comprises a central driven shaft 2 supported by bearings 3 and driven by means of a motor (not shown). Fastened on the shaft coaxially relative to it are several flanges 4 in the form of disks arranged at regular axial intervals from one another. In the example, there are nine disks 4. Each disk 4 has passing through it four bores 5 arranged at an equal radial distance from the shaft 2 and distributed at regular angular intervals (90°) about the axis of the central shaft 2. Each bore 5 of a disk 4 has an axis common to a bore 5 in each of the other disks 4, this axis being parallel to the axis of the central shaft 2. Passing through each row of coaxial bores is a hammer carrier axle 6 parallel to the shaft 2 and eccentric in relation to this. In each gap between two adjacent disks 4, one and only one of the hammer carrier axles 6 carriers a hammer 7 capable of pivoting freely about the said hammer carrier axle. For this purpose, each hammer 7 has a through-bore 17, into which the associated hammer carrier axle 6 is slipped.

Protective covers 8 cover the periphery of the disks 4 and the inter-disk spaces, whilst at the same time providing an orifice 18 for the corresponding hammer 7 in line with each inter-disk space.

In the illustrated example having four hammer carrier axles, each cover has an outer surface in the form of a quarter cylinder. The covers are aligned in four axial rows, each associated with one of the hammer carrier axles. Each cover is arranged symmetrically in relation to a plane passing through the axis of the associated hammer carrier axle and through the axis of the central shaft 2. In each row, the successive covers have between them an axial gap defining one of the orifices 18.

Each cover 8 has two mutually opposite longitudinal rims 11 bent towards the shaft 2 and engaged into corresponding notches 13 made in the periphery of the disks 4. There are four notches 13 on the periphery of each disk, distributed angularly at 90° from one another about the axis of the shaft 2. Each notch 13 is located at an equal angular distance, measured about the axis of the shaft 2, from two successive bores 5 of the same flange. The two side walls 14 of each notch 13 which are located on either side of a bottom wall 16 are parallel to one another and symmetrical relative to an axial plane 19. This makes the notches 13 very easy to make, especially because of the absence of an undercut. During operation, each notch 13 receives two rims 11 belonging to two covers 8 succeeding one another in the circumferential direction.

The notches 13, because of their different angular position about the shaft 2, between them define dovetailed bosses 21 (FIG. 3), each delimited by two walls 14 and by the periphery in the form of a sector of a cylinder which each disk possesses between two successive notches. Thus, each disk, on its periphery, has four dovetailed bosses 21 separated by four notches 13. During operation, each boss 21 is engaged in a recess of corresponding form of a cover 11, this recess being defined by the inner faces of the two rims 11 and by the cylindrical inner face of the cover. This interengagement of the boss 21 in the recess of corresponding form of the cover retains the cover 8 effectively in respect of any radial movement away from the shaft 2.

The two rims 11 received in each notch 13 fill the latter virtually completely, with the exception of the assembly clearances. During operation, under the effect of the centrifugal force exerted on each cover 8, the rims 11 are stressed by a bending force tending to part them from one another so as to escape from the notches 13. However, because of the complete filling of the notches, the rims 11 do not have room to bend sufficiently to escape radially outwards.

The notches 13 of the successive disks are aligned along four axial lines. The covers 8 sectional portions, each of which is cut to the desired length, allowing for the axial positions where the orifices 18 are to be made in order to accommodate a hammer 7 there (in the example illustrated, when the rotor is seen as a whole, the orifices 18 are arranged along a helix). Thus, some of the covers 18 cover several inter-disk spaces. Between two axially aligned orifices 18 or between each orifice 18 and the adjacent axial end of the rotor there is always only a single cover 8 of appropriate length. Consequently, the rims 11, depending on the length of the cover to which they belong, can occupy several successive axially aligned notches 13.

The successive covers 8 of the same axial row have, facing one another, edges 23 which between them define one of the orifices 18 and which project into the interdisk space associated with this orifice. Thus, the rims 11 extending over the entire axial length of each cover 8 occupy even the notches 13 adjacent to the orifices 18. Moreover, the hammers 7, which are mounted with the possibility of sliding along the hammer carrier axles 6, are positioned axially by means of the two edges 23 between which they are mounted.

The interengagement of the rims 11 and the notches 13 is intrinsically slidable parallel to the axis of the drive shaft 2. In particular, during assembly, the covers 11 are mounted by sliding on from one end of the rotor in parallel to the axis of the drive shaft 2.

Figure 4:
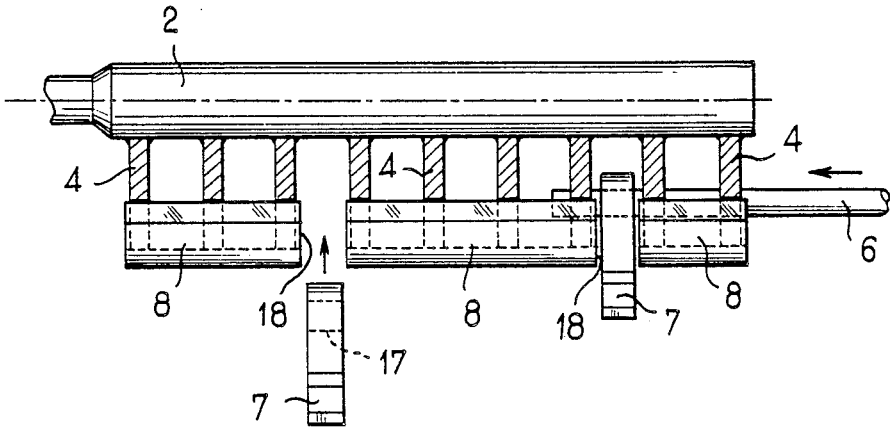
FIG. 4 is a view illustrating diagrammatically the assembling of the rotor.

More particularly, as illustrated in FIG. 4, for mounting purposes, after the disks 4 have been assembled on the shaft 2 the covers 8 are engaged slidably on the disks, distributing them over the length of the rotor so as to form the orifices 18 at the intended locations. Subsequently, a hammer carrier axle 6 is slipped into the row of bores 5 associated with the installed covers, with the corresponding hammer 7 at the same time being offered into each orifice 18 of this row, so that the hammer carrier axial 6 also passes through the bore 17 of this hammer. FIG. 4 shows a hammer 7, through which the axle 6 has already passed, and a hammer 7 being brought towards an orifice 18 which the front end of the axle 6 will reach as it is being slipped in.

FIG. 4 illustrates the assembling of a row of covers and hammers and the assembling of the corresponding axle 6. The same procedure is adopted for the other rows. Alternatively, it is possible to install all the covers beforehand and then successively put in place the axles 6 and the hammers of each row. According to another alternative version, a cover, a hammer, a cover, etc., can be installed successively in each row.

The locking of the assembly as a whole is ensured, at each end, by four stop plates 22, each of which is fastened by means of two nuts 10, hence removably, to the outer face of the end disk, so as to close off one of the bores 5 of this disk and project radially outwards to prevent the adjacent cover from escaping axially.

The considerable simplifications afforded by the embodiment just described arise because the covers, whilst being of very simple structure, are of reduced number and are assembed simply by axial sliding, without any locking means other than a locking of each axial row at its two ends.

Of course, the invention is not limited to the example described and illustrated.

In particular, the number of hammer carrier axles and the number of hammers can be different.

We claim:

1. A hammer-crusher rotor intended particularly for the shredding of motor vehicle or of domestic appliances, having flanges fastened at an axial distance from one another along a drive shaft, with which they are integral in terms of rotation, the flanges supporting eccentric axles parallel to the drive shaft, wherein a hammer is mounted so as to oscillate on one of the eccentric axles in each space between two successive flanges, and wherein protective covers covering the periphery of the flanges partially close off the rotor periphery and define between said covers passages for the hammers, each cover possessing, on a side thereof facing the drive shaft, shaped portions for interengagement with complementary shaped portions formed on the periphery of the flanges, this interengagement allowing the axial sliding of the cover, at least during assembly, but retaining the cover radially.

2. The rotor as claimed in claim 1, wherein the shaped portions belonging to the peirphery of the flanges comprise notches distributed angularly between the eccentric axles and between them defining, on the periphery of the flanges, dovetailed bosses engaged, during operation, in recesses of corresponding form of the covers.

3. The rotor as claimed in claim 2, wherein each notch possesses, on either side of a bottom wall two walls substantially parallel to one another and symmetrical in relation to an axial plane.

4. The rotor as claimed in claim 1, wherein the shaped portions of the covers comprises rims bent towards the drive shaft, and the shaped portions belonging to the periphery of the flanges comprises notches, each designed for receiving side by side two such rims belonging to two covers succeeding one another in the circumferential direction.

5. The rotor as claimed in claim 4, wherein each notch possesses, on either side of a bottom wall, two walls substantially parallel to one another and symmetrical in relation to an axial plane.

6. The rotor as claimed in claim 1, wherein the shaped portions of the successive flanges correspond to one another in an axial direction, so as together to form, for the covers, slideways extending over the entire axial length of the rotor.

7. The rotor as claimed in claim 1, wherein associated with each eccentric axle is an axial row of protective covers, and wherein, along each row, each of the axial gaps between the hammers and between a hammer and an axial end of the rotor is occupied by a single protective cover of appropriate length.

8. The rotor as claimed in claim 1, wherein the protective covers are sectional elements cut to length.

9. The rotor as claimed in claim 1, wherein the protective covers have end edges positioning the hammers axially along the eccentric axles.

10. The rotor as claimed in claim 1, having removable end stops which, in relation to an outer face of each of two end disks of the rotor, limit the axial deflection of the eccentric shafts and of the protective covers.

* * * * *